US006450099B1

(12) United States Patent
Desgland

(10) Patent No.: US 6,450,099 B1
(45) Date of Patent: Sep. 17, 2002

(54) DEVICE TO FASTEN A SEALING BASE ONTO AN AMMUNITION CASE AND BASE ADAPTED TO THIS FASTENING DEVICE

(75) Inventor: Laurent Desgland, Les Aix d'Angillon (FR)

(73) Assignee: Giat Industries (FR)

( * ) Notice: Subject to any disclaimer, the term of this patent is extended or adjusted under 35 U.S.C. 154(b) by 43 days.

(21) Appl. No.: 09/689,656

(22) Filed: Oct. 13, 2000

(30) Foreign Application Priority Data

Oct. 13, 1999 (FR) ..... 99 12858

(51) Int. Cl.[7] ..... F42B 5/18
(52) U.S. Cl. ..... 102/431; 102/467; 102/470
(58) Field of Search ..... 102/204, 430–433, 102/464, 467, 469, 470, 700

(56) References Cited

U.S. PATENT DOCUMENTS

| | | | | | |
|---|---|---|---|---|---|
| 2,818,021 | A | * | 12/1957 | Boehm et al. | 102/469 |
| 2,823,611 | A | | 2/1958 | Thayer | |
| 4,159,678 | A | * | 7/1979 | Luther et al. | 102/469 |
| 4,928,598 | A | * | 5/1990 | Sabranski et al. | 102/467 |
| 5,247,888 | A | * | 9/1993 | Conil | 102/431 |
| 6,131,519 | A | * | 10/2000 | Thiesen et al. | 102/469 |

FOREIGN PATENT DOCUMENTS

| | | | | |
|---|---|---|---|---|
| AT | 259416 | * | 1/1968 | 102/469 |
| BE | 572090 A | | 11/1958 | |
| CH | 263 313 A | | 4/1950 | |
| DE | 284253 | * | 5/1915 | 102/470 |
| DE | 731750 | * | 6/1943 | 102/469 |
| DE | 736 792 C | | 6/1943 | |
| DE | 33 32 676 A | | 3/1985 | |
| FR | 1078338 | * | 11/1954 | 102/469 |
| GB | 313 560 A | | 6/1929 | |
| GB | 527 918 A | | 6/1929 | |
| IT | 307193 | * | 2/1937 | 102/469 |

* cited by examiner

*Primary Examiner*—Harold J. Tudor
(74) *Attorney, Agent, or Firm*—Parkhurst & Wendel, LLP

(57) ABSTRACT

A joining device for a sealing base, notably for a large calibre munition having a combustible case, device in which the case carries or is fitted with a cup having a central opening, said device being characterised in that support means are fastened to the cup by first linking means, said supporting means being in the form of a rod incorporating a cylindrical support onto which a bore of the base is positioned, said base being made integral with the support means by second linking means.

13 Claims, 4 Drawing Sheets

DEVICE TO FASTEN A SEALING BASE ONTO AN AMMUNITION CASE AND BASE ADAPTED TO THIS FASTENING DEVICE

BACKGROUND OF THE INVENTION

1. Field of Invention

The technical scope of the invention is that of sealing bases for munitions, notably large calibre, as well as devices to fasten them onto an ammunition case.

2. Description of Related Art

A sealing base is known notably by patent DE2303790 that comprises a steel body having a cylindrical rim onto which a rubber sealing ring is affixed.

This base is joined to a combustible case by means of a washer arranged in a groove of an axial extension of the base.

The main drawback of such a device lies in that the base can not be fastened to the case before said case has been filled with powder.

Disassembly of the base at a later date proves impossible without the disassembly of the whole projectile and removal of the powder.

A base is also known by U.S. Pat. No. 5,048,421 that is fastened by being screwed onto a threaded part of the combustible case.

However, such a solution is complicated since it requires the manufacture of a case incorporating a threaded part, this being difficult to reliably obtain for a case of a combustible material such as nitrocellulose impregnated cardboard.

Lastly, patent EP463904 describes a base that incorporates a flexible ring intended to co-operate with a groove carried on a tubular part integral with the combustible case bottom.

Such a solution has the drawback of being structurally complicated, relatively fragile and impossible to disassemble.

OBJECT AND BRIEF SUMMARY OF THE INVENTION

It is the aim of the invention to propose a sealing base fastening device that does not suffer from the drawbacks of known devices.

Thus, the device according to the invention allows a base to be fastened to a combustible case after this has been filled with powder.

The base can be easily disassembled so as to carry out inspection or powder replacement operations.

Thus, the subject of the invention is a joining device for a sealing base of an ammunition, notably for a large calibre munition having a combustible case, device in which the case carries or is fitted with a cup having a central opening, said device being characterised in that support means are fastened to the cup by first linking means, said supporting means being in the form of a rod incorporating a cylindrical support onto which a bore of the base is positioned, said base being made integral with the support means by second linking means.

Advantageously, the support means can be formed by an ignition system.

The support means can incorporate a threaded part intended to co-operate with a nut that constitutes the second linking means and is housed in a countersink arranged in the base.

The cup can be formed as part of the combustible case or else be made integral with a cylindrical wall of the case by fastening means.

According to a particular embodiment, the first linking means can comprise an intermediate part fastened at the central opening.

According to one embodiment, the intermediate part can be a ring incorporating a circular groove housing the rim of the central opening, said ring having at least two elastically deformable lips allowing the rim to be introduced into the groove.

According to another embodiment, the intermediate part can comprise a circular groove housing at least two tabs integral with the cup.

The cup can incorporate at least one side opening allowing the powder to be introduced.

The cup can incorporate at least three openings evenly spaced angularly and delimited by radial arms converging towards an axial ring-shaped collar.

A further subject of the invention is a base adapted so as to be able to be made integral with a case using such a fastening device.

The sealing base according to the invention is intended to be made integral with a combustible case using such a joining device. This base is characterised in that it incorporates a smooth axial bore intended to co-operate with a rod-like support means integral with the case.

The axial bore of the base will be enlarged into a countersink on the rear face of the base, said countersink being able to accommodate a fastening nut.

BRIEF DESCRIPTION OF THE DRAWINGS

The invention will be better understood after reading the following description of different embodiments, said description being made with reference to the appended drawings, in which.

DETAILED DESCRIPTION OF PREFERRED EMBODIMENTS

Figure 1:
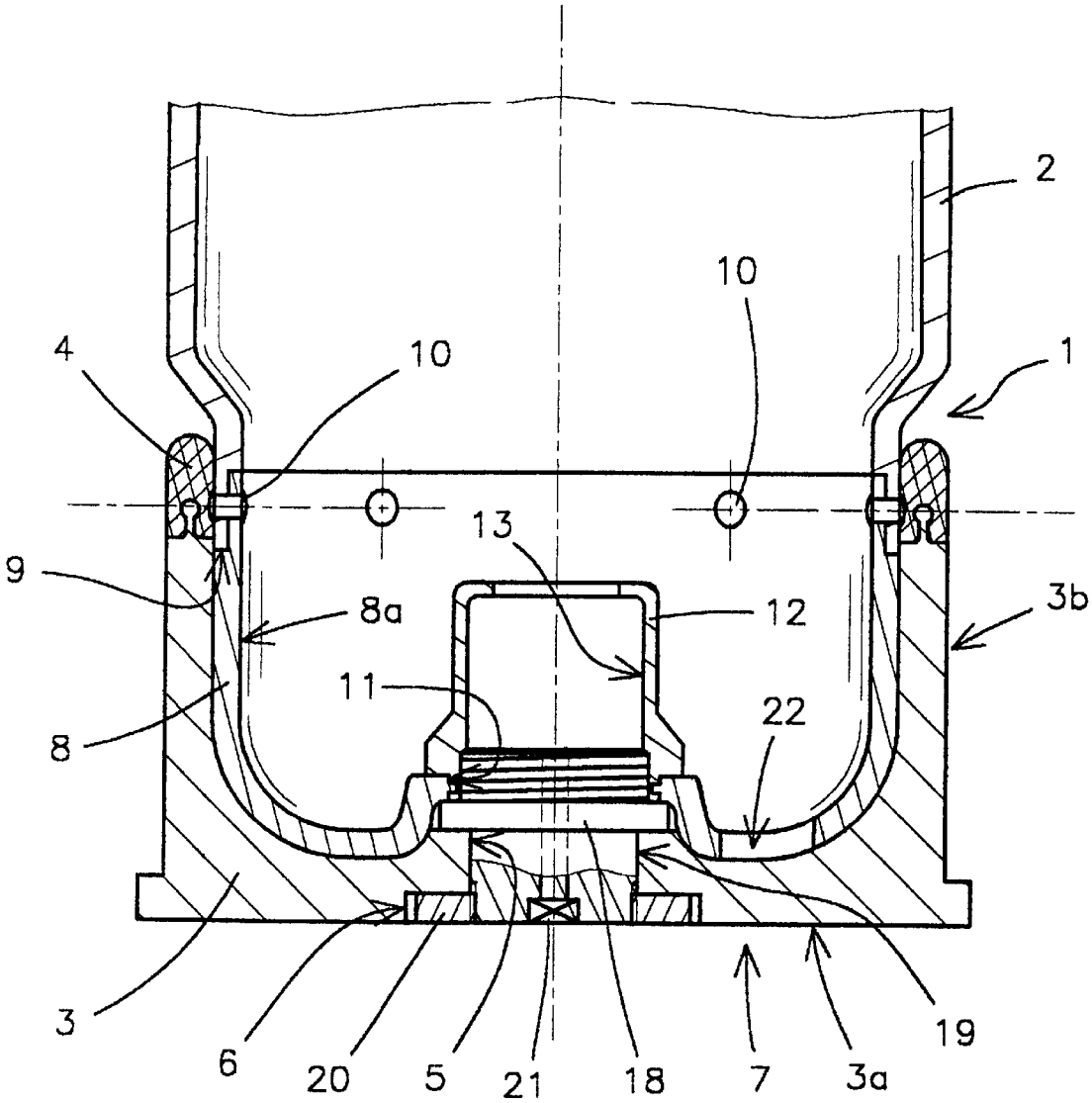
FIG. 1 shows a longitudinal section of a first embodiment of a device according to the invention to fasten a base to the rear part of a large calibre munition case.

With reference to FIG. 1, a large calibre munition 1 incorporates a case 2 of combustible material, for example nitrocellulose impregnated cardboard, such case having a base 3 affixed to its rear part.

The ammunition case is intended to accommodate a projectile and a load of powder (not shown).

The base 3 is made of steel. It incorporates a massive bottom 3*a* and a cylindrical rim 3*b* at the end of which a rubber sealing lip 4 is fastened.

The base 3 has a smooth axial bore 5 enlarged into a countersink 6 made in the rear face 7 of the base 3.

The combustible case 2 carried a cup 8 that substantially matches the inside shape of the base 3.

The cup 8 has a cylindrical part 8*a* whose upper rim has a notch 9 intended to accommodate the end of the case 2.

The cup 8 and the case 2 are joined together by means of rivets 10 evenly spaced angularly.

Figure 2:
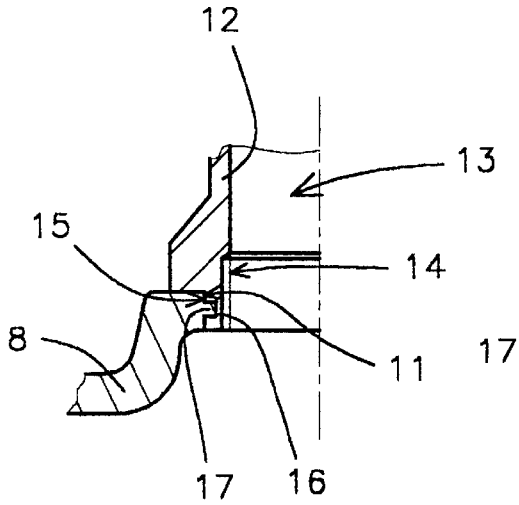
FIG. 2 is an enlarged detailed view of the fastening of the tubular part on the cup.
Figure 3:
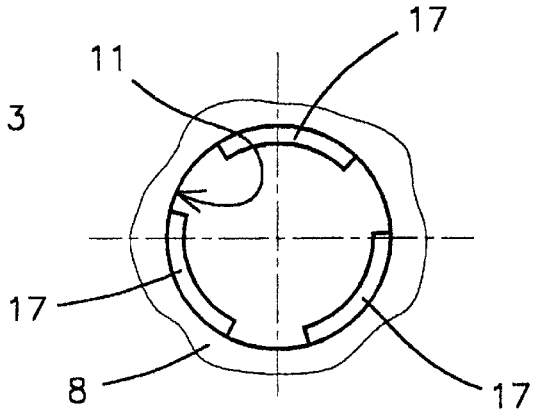
FIG. 3 is a detailed view of a central part of the cup.

The cup 8 incorporates a central opening 11 onto which a tubular intermediate part 12 is fastened (see also FIG. 2). It also incorporates at least one side opening 22 intended to allow the powder to be loaded.

The tubular intermediate part 12 is roughly cylindrical. It incorporates a bore 13 onto which a screw cutting 14 has been made.

It has an external cylindrical support 15 housed in the opening 11 of the cup 8. The cylindrical support 15 incorporates a circular groove 16 intended to accommodates tabs 17 integral with the cup and evenly spaced angularly (here there are 3 tabs).

The tabs 17 are deformed when the tubular part 12 is introduced into the opening 11 of the cup 8 and they join the tubular part to the cup.

The cup will be made, for example, of a material such as polyamide. The tubular intermediate part 12 will be made of the same material or else of metal.

Support means 18, roughly rod-shaped, are fastened to the tubular part 12 by threading made on the support means and co-operating with the screw cutting 14 made on the tubular part.

The support means 18 incorporate a cylindrical support 19 received in the axial bore 5 of the base 3.

The intermediate part 12 constitutes first linking means enabling the support means to be fastened to the cup.

In this embodiment, said part also has an elongated cylindrical shape delimiting a volume along the munition axis into which the grains of powder do not penetrate during loading. The development of the flame generated by the pyrotechnic ignition means is thereby facilitated, such means being advantageously integrated to the support means 18.

The cylindrical support 19 of the support means 18 is extended by threading intended to co-operate with a nut 20. Said nut forms second linking means allowing the base 3 to be made integral with the support means 18, and thus with the cup 8.

The nut 20 is housed in the countersink 6 so as not to protrude from the rear face 7 of the base.

The nut 20 will be screwed in place using appropriate tooling. Preferably, holes will be made is the nut is parallel to its threading allowing a claw wrench of a known type to be engaged in the nut.

The support means 18 will also carry pyrotechnic ignition means for the propellant charge, and notably an igniter 21 (such as a primer) and one or several relays. This structure is well known to the expert and is thus not shown here in any further detail.

The munition 1 is assembled as follows:

The projectile (not shown) is fastened to the case by appropriate means, for example a linking ring such as that described in document EP307307.

The case 2 and the cup 8 are joined together, said cup carrying the tubular intermediate part 12.

Loading with propellant powder is carried out by introducing the grains of powder through the opening 22 of the cup 8.

When the powder loading operation is finished, the primer/support means 18 are screwed onto the tubular part 12.

Lastly, the base 3 is fastened to the cup 8 by means of the nut 20.

By way of a variant, the tubular part 12 and the cup 8 can advantageously be bonded together or else can be made as one part.

Figure 6:
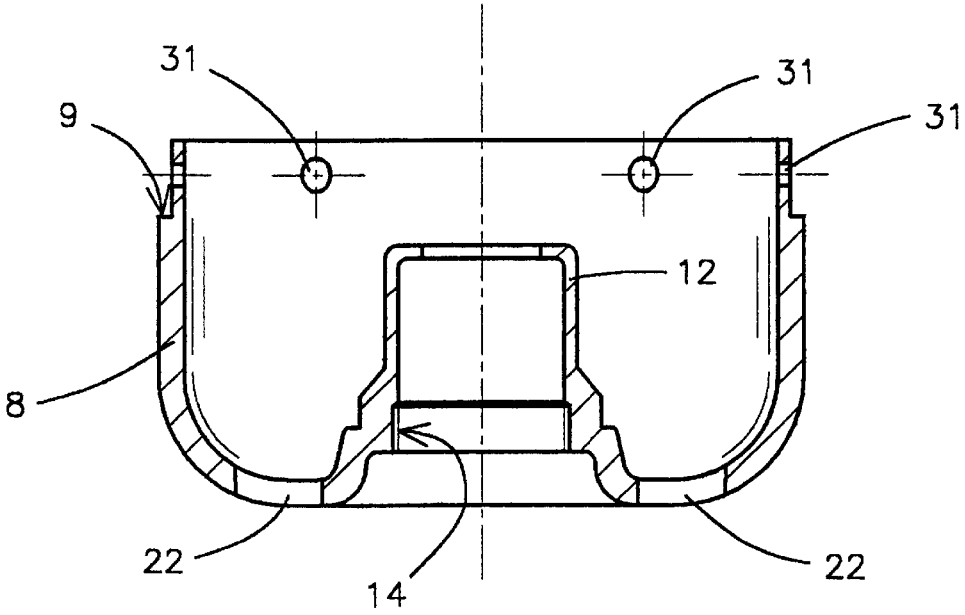
FIG. 6 is a section view of the cup according to a second embodiment of the invention.

FIG. 6 thus shows a cup 8 in which the tubular part 12 and the cup 8 are formed in a single part of a plastic material. The screw cutting 14 is intended to receive the support means (not shown) . Several side holes 22 are made. Holes 31 are intended to receive the fastening rivets 10 for the case 2.

The number of side holes 22 made in the cup 8 can also be varied.

Figure 4:
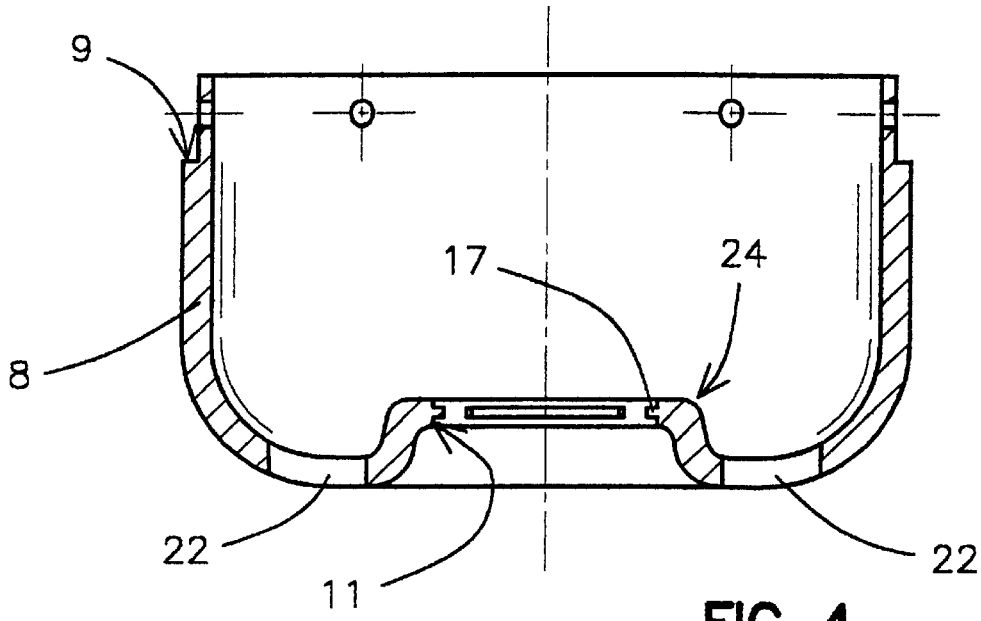
FIGS. 4 and 5 show the cup on its own according to a variant embodiment of the invention, FIG. 4 being a section along line AA shown in FIG. 5.
Figure 5:
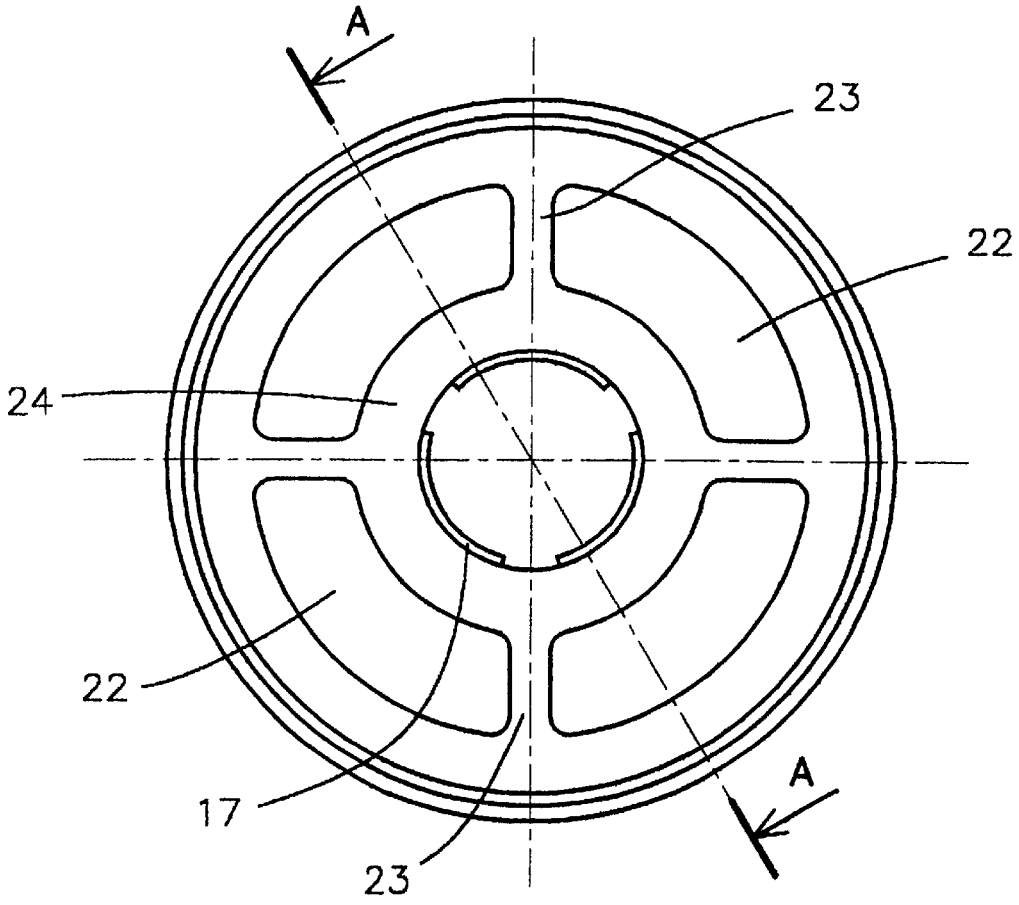

FIGS. 4 and 5 thus show a cup 8 incorporating four openings 22 evenly spaced angularly and delimited by radial arms 23 converging toward an axial ring-shaped collar 24.

The axial collar 24 carries the axial opening 11 intended to receive the tubular intermediate part. As in the embodiment described with reference to FIG. 2, the cup 8 incorporates tabs 17 intended to allow the fastening of the tubular intermediate part.

This embodiment of the cup firstly allows the powder loading operations to be made easier by increasing the number of openings 22 and secondly gives a certain flexibility to the base fastening device, said flexibility being provided by the arms 23.

Figure 7:
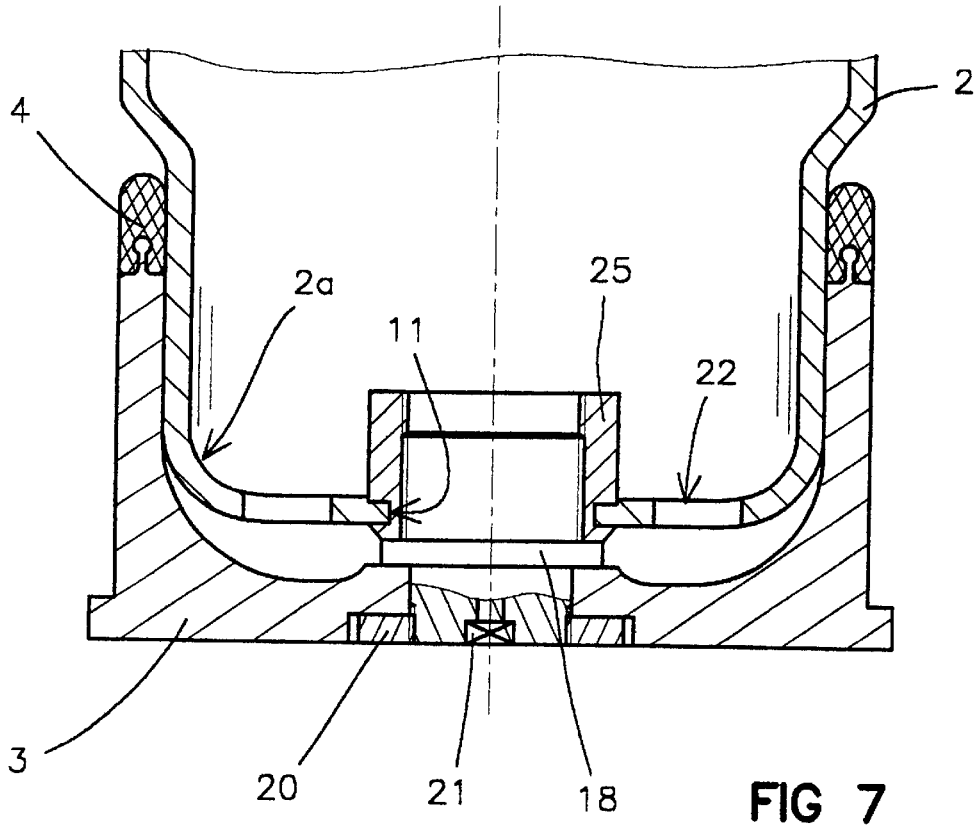
FIG. 7 shows a longitudinal section of a third embodiment of a device according to the invention to fasten a base to the rear part of a large calibre munition case.

FIGS. 7 and 8 show a third embodiment of a device according to the invention.

According to this embodiment, the case 2 incorporates a combustible bottom 2*a* forming a cup. This bottom has an axial opening 11 into which the support means 18 is fastened by means of an intermediate part formed here by a ring 25.

Figure 8A:
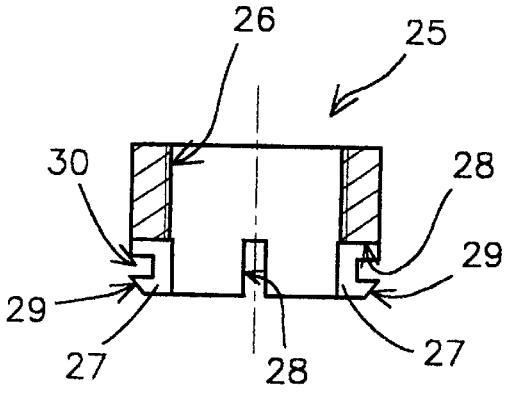
FIGS. 8*a* and 8*b* are detailed views showing the ring implemented in the embodiment shown in FIG. 7, FIG. 8*a* being a section of the ring along line BB shown in FIG. 8*b*.
Figure 8B:
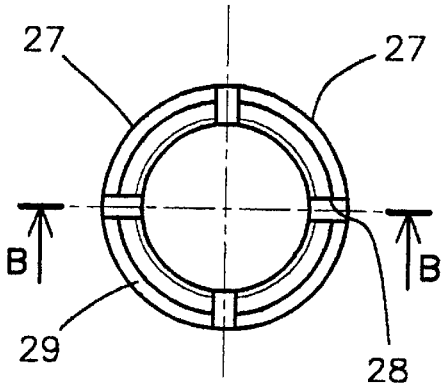

The ring 25 can be seen in more detail in FIGS. 8*a* and 8*b*. It is made of a plastic material (for example, polyamide) and is cylindrical in shape. It incorporates an axial female threading 26 that extends over its full height. At one of its ends it incorporates a ring-shaped groove 30 and four lips 27 that are evenly spaced angularly and separated by radial slots 28.

The lips all have a tapered bevel 29 that makes it easier to introduce the ring into the opening 11 of the case.

During this introduction operation, the lips can elastically deform radially. The rim of the opening of the case 2 can thus be positioned in the ring-shaped groove 30. As the lips recover their initial unformed position they imprison the case rim in the groove 30 and thus join the ring 25 to the case.

The case can thereafter be loaded with powder via the opening or openings 22.

After loading, the support means/ignition means 18 are screwed into the female threading 26 of the ring 25.

The base 3 is then set into position and is linked to the support means 18, as before, by a nut 20.

The different embodiments described above can naturally be combined.

For example, a ring such as that described with reference to FIG. 7 can be used with a cup 8 in a plastic material such as that described in FIG. 1. In this case, tabs need not be provided inside the opening 11, the ring being made integral with the cup thanks to the presence of the deformable lips.

It is also possible for the ring 25 to be given a different shape, notably a tubular shape allowing a powder-free space to be arranged in the vicinity of the pyrotechnic primer outlet.

What is claimed is:

1. A joining device for joining a sealing base (3) attached to a combustible case of a large caliber munition, the case including a cup **(2*a*, 8) having a central opening (11)** and the base being detachable from the case even after the case is filled with powder, said device comprising:

removable support means (18) for attachment to the base;

separate first linking means (12, 25) for fastening said support means to the cup; and seperate renovable second linking means (20) for connecting the removable support means to the base.

2. A joining device according to claim 1, wherein the support means (18) comprise an ignition system.

3. A joining device according to claim 1, wherein said second linking means further comprises a nut (20) located in a countersink (6) in the base (3), and the support means (18) comprise a threaded part for engaging said nut (20).

4. A joining device according to claim 1, wherein the cup **(2*a*)** comprises a portion of the combustible case.

5. A joining device according to claim 1, further comprising fastening means (10) for integrally fastening the cup (8) to a cylindrical wall of the combustible case (2).

6. A joining device according to claim 4, wherein the first linking means comprises an intermediate part (12, 25) fastened to the cup at the central opening (11).

7. A joining device according to claim 6, wherein the intermediate part comprises a ring (25) having a circular groove (30) for receiving the rim of the central opening (11), said ring having at least two elastically deformable lips (27) for lockingly engaging the ring with the rim.

8. A joining device according to claim 6, wherein the intermediate part (12) comprises a circular groove (16) for receiving at least two tabs (17) integral with the cup (8).

9. A joining device according to claim 1, wherein the cup (8) further comprises at least one side opening (22) for receiving powder.

10. A joining device according to claim 9, wherein the cup (8) further comprises at least three openings (22) evenly spaced angularly and delimited by radial arms (23) converging. towards an axial ring-shaped collar (24).

11. A sealing base according to claim 1, wherein said supporting means comprises a rod having a cylindrical support (19) for location in a bore (5) of the base (3).

12. A joining device according to claim 1 in combination with a sealing base (3) for connection with a case (2), the sealing base comprising:

a surface having a smooth axial bore (5) for receiving a rod-shaped support means (18) integral with the case (2).

13. The joining device according to claim 12 in combination with a sealing base (3), wherein the axial bore (5) further comprises an enlarged countersink (6) portion on the rear face (7) of the base, said countersink portion for receiving a fastening nut (20).

* * * * *